US009174218B2

(12) United States Patent
Merle et al.

(10) Patent No.: US 9,174,218 B2
(45) Date of Patent: Nov. 3, 2015

(54) COMMINUTING AND DISPERSING APPARATUS

(75) Inventors: Thomas Merle, Grenzach-Wyhlen (DE); Stefan Wienberg, Bad Krozingen (DE)

(73) Assignee: FrymaKoruma AG, Rheinfelden (CH)

( * ) Notice: Subject to any disclaimer, the term of this patent is extended or adjusted under 35 U.S.C. 154(b) by 789 days.

(21) Appl. No.: 13/254,921

(22) PCT Filed: Mar. 6, 2009

(86) PCT No.: PCT/DE2009/000318

§ 371 (c)(1),
(2), (4) Date: Sep. 6, 2011

(87) PCT Pub. No.: WO2010/099767

PCT Pub. Date: Sep. 10, 2010

(65) Prior Publication Data

US 2011/0315799 A1 Dec. 29, 2011

(51) Int. Cl.
*B02C 7/10* (2006.01)
*B01F 3/12* (2006.01)
(Continued)

(52) U.S. Cl.
CPC ..... *B02C 7/10* (2013.01); *B01F 3/1221* (2013.01); *B01F 5/104* (2013.01); *B01F 7/00816* (2013.01); *B01F 7/00825* (2013.01); *B01F 7/00833* (2013.01)

(58) Field of Classification Search
CPC ..... B02C 7/12; B02C 2/00; B02C 2/02; B02C 2/04; B02C 2/08; B02C 7/02; B02C 7/10
USPC ..... 241/98, 84, 86, 86.1, 89.3, 92, 261.1, 241/260.1, 293, 295
See application file for complete search history.

(56) References Cited

U.S. PATENT DOCUMENTS 4,283,016 A * 8/1981 Reinhall ..... 241/21
(Continued)

FOREIGN PATENT DOCUMENTS

DE 825084 12/1951
DE 2742229 A1 3/1979
(Continued)

OTHER PUBLICATIONS

International Search Report for PCT/DE2009/000318, dated Nov. 3, 2010.
(Continued)

*Primary Examiner* — Shelley Self
*Assistant Examiner* — Matthew G Katcoff
(74) *Attorney, Agent, or Firm* — Bachman & LaPointe, P.C.

(57) ABSTRACT

An apparatus (100) has a batch container (110) having one or more openings (120) for the introduction of the substances to be processed, one or more openings (130) for the discharge of the processed substances, and a process chamber (140) having a rotor (150) and a stator (160), the rotor (150) mounted rotatably about a rotational axis (155) with respect to the stator (160) for the purpose of processing substances introduced into the process chamber (140). The stator (160) has a working surface (161) which is inclined at an angle W1 in relation to the rotational axis (155) of the rotor (150) and the rotor (150) has a working surface (151) which is inclined at an angle W2>W1 in relation to the rotational axis (155) of the rotor (150), such that the working surfaces (161, 151) of stator (160) and rotor (150) are disposed at an acute angle relative to each other. The process chamber (140), in which the introduced substances are dispersed, comminuted and homogenized, is formed between the rotor (150) and the stator (160) and is of hollow-conical cross section.

20 Claims, 2 Drawing Sheets

(51) Int. Cl.
*B01F 5/10* (2006.01)
*B01F 7/00* (2006.01)

(56) References Cited

U.S. PATENT DOCUMENTS

| | | | | | |
|---|---|---|---|---|---|
| 5,398,876 | A | * | 3/1995 | Reinhall | 241/28 |
| 5,799,885 | A | * | 9/1998 | Karra | 241/30 |
| 6,024,308 | A | * | 2/2000 | Bartels et al. | 241/27 |
| 7,282,114 | B1 | * | 10/2007 | Kankaanpaa | 162/57 |
| 2003/0213860 | A1 | * | 11/2003 | Pilao | 241/261.1 |

FOREIGN PATENT DOCUMENTS

| | | | |
|---|---|---|---|
| DE | 29608713 | U1 | 8/1996 |
| DE | 202007012740 | U1 | 12/2007 |
| EP | 1900422 | A1 | 3/2008 |
| WO | 8602860 | A1 | 5/1986 |

OTHER PUBLICATIONS

Wolf-Ulrich Kohler et al., A New Generation of Supraton Machines, Technische Mitteilungen Krupp, Jun. 1, 1988, pp. 53-60, vol. 1, Fried.Krupp GmbH Fachbuecherei,Essen, Germany.

* cited by examiner

COMMINUTING AND DISPERSING APPARATUS

BACKGROUND

The invention relates to an apparatus for dispersing, in particular, liquid to semi-liquid substance mixtures and for comminuting particles and suspensions, comprising a batch container having one or more openings for the introduction of the substances to be processed and one or more openings for the discharge of the substances to be processed, and comprising a process chamber having a rotor and a stator, the rotor being mounted rotatably about a rotational axis with respect to the stator for the purpose of processing substances introduced into the process chamber.

Dispersing apparatuses of the type stated in the introduction are generally used in the prior art to mix or comminute liquid or semi-liquid substances with other liquid, semi-liquid or powdery substances such that a substantially homogeneous and non-agglomerated mass is formed. Known dispersing apparatuses have the drawback, however, that a reliable and effective processing of substances having very different properties, such as granularity in the case of powders or viscosity in the case of liquids, is not guaranteed.

A dispersing apparatus of the type stated in the introduction is known from DE 296 08 713 U1. In this apparatus, teeth and/or protrusions are provided to blend highly viscous materials in a short time, which teeth and/or protrusions are configured such that, when the axial distance between rotor and stator is adjusted, the shear splitting volume changes overproportionally.

In addition, DE 825 084 discloses an apparatus for the sound-vibration treatment of materials, in which, for the purpose of a uniform, intensive acoustic irradiation, a passage gap is provided for the materials to be treated, the width of which passage gap can be periodically altered with sound vibration frequency.

SUMMARY

The object of the invention is to provide an apparatus by means of which reliable and effective processing of substances with very different properties, such as homogeneity, granularity in the case of powders or viscosity in the case of liquids, is enabled.

For an apparatus of the type stated in the introduction, this object is achieved by virtue of the fact that the stator has a working surface which is arranged inclined at an angle W1 with respect to the rotational axis of the rotor and the rotor has a working surface which is arranged inclined at an angle W2>W1 with respect to the rotational axis of the rotor such that the working surfaces of stator and rotor are disposed at an acute angle relative to each other, and the process chamber of hollow-conical cross section, in which the introduced substances are dispersed, comminuted and homogenized, is formed between the rotor and the stator.

Preferred embodiments of the invention are the subject of the sub-claims.

In the flange apparatus according to the invention, the combination of features whereby the stator has a working surface which is arranged inclined at an angle W1 with respect to the rotational axis of the rotor and the rotor has a working surface which is arranged inclined at an angle W2>W1 with respect to the rotational axis of the rotor such that the working surfaces of stator and rotor are disposed at an acute angle relative to each other, and the process chamber of hollow-conical cross section, in which the introduced substances are dispersed, comminuted and homogenized, is formed between the rotor and the stator, has the result that a high degree of variability in the positioning of the mutually opposing working surfaces of rotor and stator is obtained. In this context, working surfaces having surface structures adapted to different functions can on the one hand be used, and the rotational velocity of the rotor and the width of the cavity between the working surfaces of rotor and stator can be varied. In addition, in the apparatus according to the invention, on the one hand a very robust, and on the other hand a very accurate controlling of the position of the axially displaceably mounted stator are obtained.

According to a first preferred embodiment of the apparatus according to the invention, it is provided that the process chamber is orientated such that the introduced substances are transported from an inlet region along the working surfaces of stator and rotor radially outwards in the direction of an outlet region.

According to another preferred embodiment of the apparatus according to the invention, it is provided that the inlet region of the process chamber is configured wider than the outlet region.

According to an important preferred embodiment of the apparatus according to the invention, it is provided that the working surfaces of the stator and/or of the rotor have a predefined surface structure. A surface structure can here be formed by a plurality of straight or bent projections or notches.

According to another important preferred embodiment of the apparatus according to the invention, it is provided that the stator is mounted such that it is displaceable in an axially reciprocatable manner in the direction of the rotor and is displaceable by means of a displacement device within a predefined stroke range in the direction of the rotor and, at the same time, is lockable in any chosen position in order to predefine the volume of the process chamber.

The stator can here preferably be displaceably mounted within an outer housing of the apparatus and be provided with an external thread, the displacement device containing a pin guided through a cutout in the outer housing and rotatably mounted on the outer housing, which pin engages in the external thread of the stator. The pin can here be rotatable in a controlled manner by means of an electromotive drive.

A mixing chamber provided with a rotatable mixing blade, for supplying further substances into the process chamber, is provided between the batch container and the process chamber. Furthermore, an inducer screw is preferably provided between the mixing blade and the process chamber, which inducer screw forces the substances intermixed in the mixing chamber in the direction of the process chamber. The mixing blade, the inducer screw and the rotor are preferably mounted on a common shaft.

According to a further preferred embodiment of the apparatus according to the invention, it is provided that a receiving chamber for processed substances, which is provided with an outlet opening, is provided downstream of the outlet region of the process chamber. A rotatable distributor blade, which can preferably be at least indirectly connected to the rotor, can be provided in the receiving chamber.

In the apparatus according to the invention, the substances, starting from the outlet opening of the receiving chamber, can be at least partially fed back into the batch container and/or into the mixing chamber.

The rotation speed of the motor which drives the rotor, the mixing blade and the inducer screw is preferably adjustable and is thereby adaptable to the viscosity and/or granularity of the substances to be processed.

According to a further preferred embodiment of the apparatus according to the invention, it is provided that the rotor is divided into an upper and a lower part, the working surface of the upper part of the rotor being configured such that it is bent inwards in an area of impact of the substances to be processed.

BRIEF DESCRIPTION OF THE DRAWINGS

The apparatus according to the invention is explained below with reference to a preferred embodiment represented in the figure of the drawing, in which.

DETAILED DESCRIPTION

Figure 1:
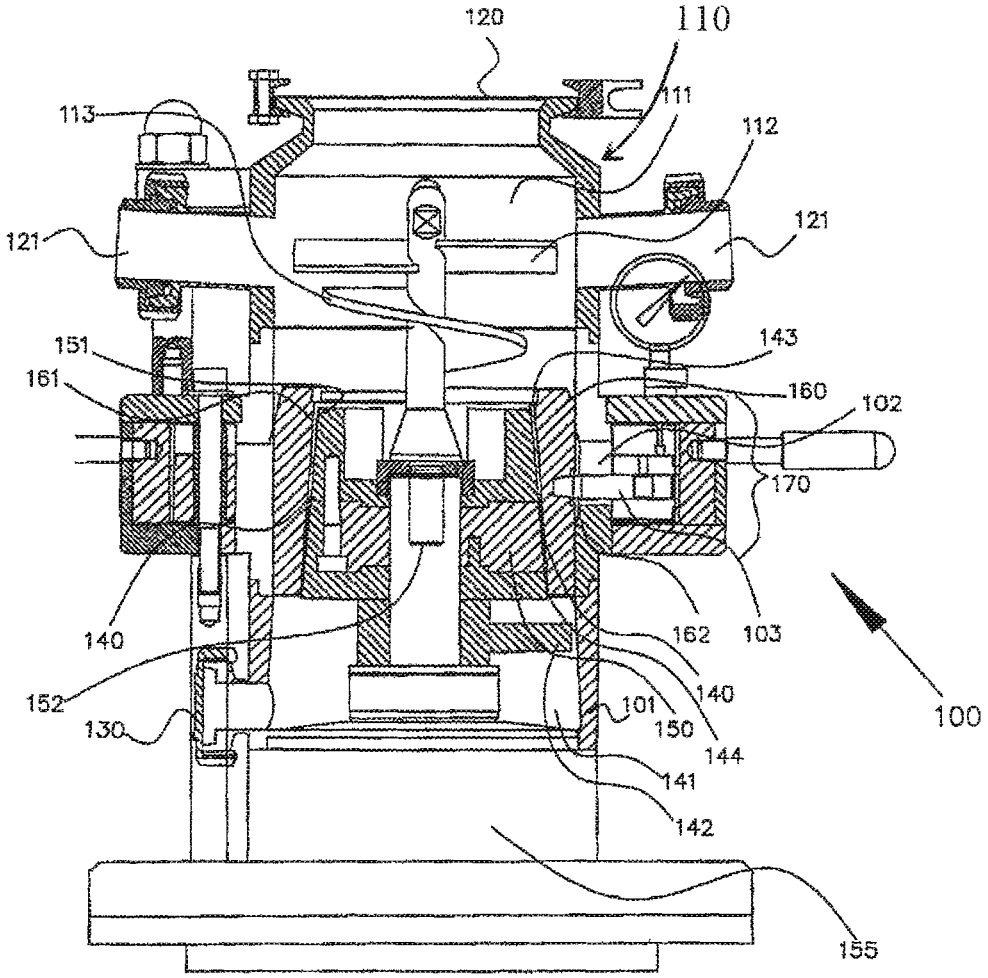
FIG. 1 shows a preferred embodiment of the apparatus according to the invention in a cross-sectional view.
Figure 4:
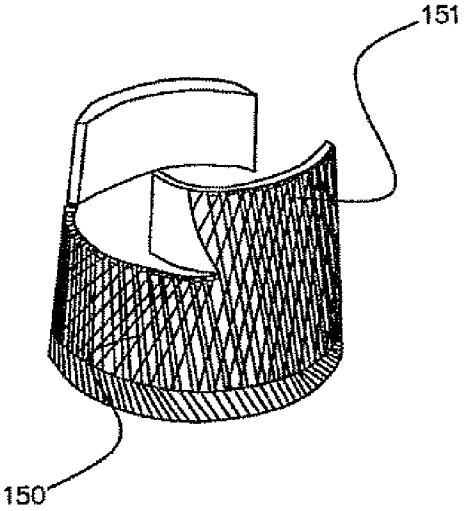
FIG. 4 shows the rotor of the further preferred embodiment, represented in FIG. 1, of the apparatus according to the invention in a side view.
Figure 3:
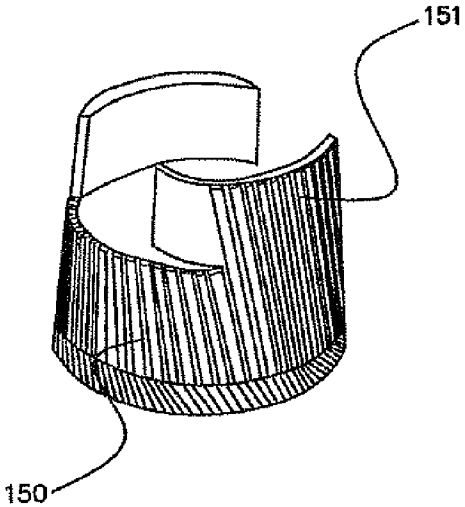
FIG. 3 shows the rotor of the further preferred embodiment, represented in FIG. 1, of the apparatus according to the invention in a side view.

The apparatus (100) according to the invention, represented in FIGS. 1 and 4, for dispersing, in particular, liquid to semi-liquid substance mixtures and for comminuting granular substance mixtures and suspensions contains a batch container (110) having an opening (120) and an additional opening (121) for the introduction of the substances to be processed and an opening (130) for the discharge of the processed substances, and a process chamber (140) having a rotor (150) and a stator (160), the rotor (150) being mounted rotatably about a rotational axis (155) with respect to the stator (160) for the purpose of dispersing substances introduced into the process chamber (140).

The stator (160) has a working surface (161) which is arranged inclined at an angle W1 with respect to the rotational axis (155) of the rotor (150) and the rotor (150) has a working surface (151) which is arranged inclined at an angle W2>W1 with respect to the rotational axis (155) of the rotor (150), the working surfaces (161, 151) of stator (160) and rotor (150) facing each other at an acute angle. The process chamber (140) of hollow-conical cross section, in which the introduced substances are dispersed, comminuted and homogenized, is formed between the rotor (150) and the stator (160).

The process chamber (140) is orientated such that the introduced substances are transported from an inlet region (143) along the working surfaces (161, 151) of stator (160) and rotor (150) radially outwards in the direction of an outlet region (144). The inlet region (143) is in this case configured wider than the outlet region (144).

The working surfaces (161, 151) of the stator (160) and of the rotor (150) respectively have a predefined surface structure, namely a plurality of bent projections.

Figure 2:
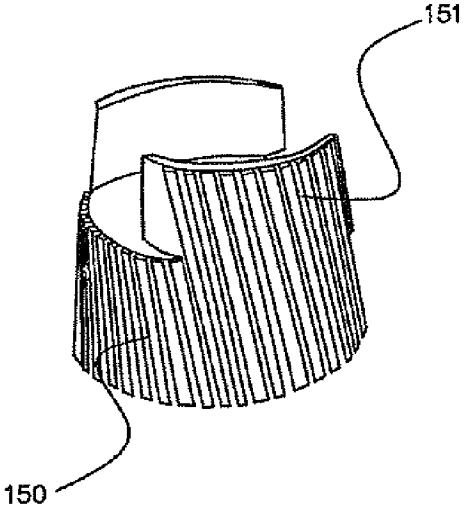
FIG. 2 shows the rotor of the preferred embodiment, represented in FIG. 1, of the apparatus according to the invention in a side view.

As represented in FIG. 2, the rotor (150) is additionally divided into an upper and a lower part, the working surface (151) of the upper part of the rotor (150) being configured such that it is bent inwards in an area of impact of the substances to be processed.

The stator (160) is mounted such that it is displaceable in an axially reciprocatable manner in the direction of the rotor (150) and is displaceable by means of a displacement device (170) within a predefined stroke range in the direction of the rotor (150) and, at the same time, is lockable in any chosen position in order to predefine the volume of the process chamber (140).

The stator (160) is here displaceably mounted within an outer housing (101) of the apparatus and provided with an external thread (162), the displacement device (170) containing a pin (103) guided through a cutout in the outer housing (101) and rotatably mounted on the outer housing (101), which pin engages in the external thread (162) of the stator (160). The pin (103) is here rotatable in a controlled manner by means of an electromotive drive.

A mixing chamber (111) provided with a rotatable mixing blade (112), for supplying further substances into the process chamber (140), is provided between the batch container (110) and the process chamber (140).

Furthermore, an inducer screw (113) is provided between the mixing blade (112) and the process chamber (140), which inducer screw forces the substances intermixed in the mixing chamber (111) in the direction of the process chamber (140). The mixing blade (112), the inducer screw (113) and the rotor (150) are here mounted on a common shaft (152).

A receiving chamber (141) for processed substances, which is provided with an outlet opening (130), is provided downstream of the outlet region (144) of the process chamber (140). A rotatable distributor blade (142), which is connected to the speed-adjustable rotor (150), is provided in the receiving chamber (141).

The processed substances, starting from the outlet opening (130) of the receiving chamber (141), can be at least partially fed back into the mixing chamber.

The above-described illustrative embodiment of the invention serves merely to provide a better understanding of the inventive teaching defined by the claims, which is not restricted per se by the illustrative embodiment.

What is claimed is:

1. An apparatus (100) for dispersing, in particular, liquid to semi-liquid substance mixtures and for comminuting particles and suspensions, comprising a batch container (110) having one or more openings (120, 121) for the introduction of the substances and one or more openings (130) for the discharge of the substances, and comprising a process chamber (140) having a rotor (150) and a stator (160), the rotor (150) being mounted rotatably about a rotational axis (155) with respect to the stator (160) for the purpose of processing substances introduced into the process chamber (140), characterized in that:

the stator (160) has a working surface (161) which is arranged inclined at an angle W1 in relation to the rotational axis (155) of the rotor (150) and the rotor (150) has a working surface (151) which is arranged inclined at an angle W2>W1 in relation to the rotational axis (155) of the rotor (150), such that the working surfaces (161, 151) of stator (160) and rotor (150) are disposed at an acute angle relative to each other, and the process chamber (140) of hollow-conical cross section, in which the introduced substances are dispersed, comminuted and homogenized, is formed between the rotor (150) and the stator (160);

the one or more openings for the introduction of the substances comprise a first opening (120) along the rotational axis (155) and one or more additional openings (121) between the first opening (120) and the process chamber (140); and the rotor (150) is divided into an upper and a lower part, the working surface (151) of the upper part of the rotor (150) having:

a first portion along which the working surface is continuous with the working surface along the lower part; and a second portion along which the working surface is bent tangentially inwards relative to the rotational axis (155) from the first portion in an area of impact of the substances to be processed.

2. The apparatus as claimed in claim 1, characterized in that the process chamber (140) is orientated such that the introduced substances are transported from an inlet region (143) along the working surfaces (161, 151) of stator (160) and rotor (150) radially outwards in the direction of an outlet region (144) of the process chamber (140).

3. The apparatus as claimed in claim 2, characterized in that the inlet region (143) of the process chamber (140) is configured wider than the outlet region (144) of the process chamber (140).

4. The apparatus as claimed in claim 1, characterized in that a surface structure of at least one of the working surfaces (161, 151) is formed by a plurality of straight projections.

5. The apparatus as claimed in claim 1, characterized in that a surface structure of at least one of the working surfaces (161, 151) is formed by a plurality of bent projections.

6. The apparatus as claimed in claim 1, characterized in that a surface structure of at least one of the working surfaces (161, 151) is formed by a plurality of straight notches.

7. The apparatus as claimed in claim 1, characterized in that a surface structure of at least one of the working surfaces (161, 151) is formed by a plurality of bent notches.

8. The apparatus as claimed in claim 1, characterized in that the stator (160) is mounted such that it is displaceable in an axially reciprocatable manner in the direction of the rotor (150) and is displaceable by means of a displacement device (170) within a predefined stroke range in the direction of the rotor and, at the same time, is lockable in any chosen position in order to predefine the volume of the process chamber (140).

9. The apparatus as claimed in claim 8, characterized in that the stator (160) is displaceably mounted within an outer housing (101) of the process apparatus (100) and is provided with an external thread, the displacement device (170) containing a pin (103) guided through a cutout (102) in the outer housing (101) and rotatably mounted on the outer housing (101), which pin engages in the external thread (162) of the stator (160) to provide lockability in said chosen position.

10. The apparatus as claimed in claim 9, characterized in that the pin (103) is rotatable in a controlled manner by means of an electromotive drive.

11. The apparatus as claimed in claim 1, characterized in that a mixing chamber (111) provided with a rotatable mixing blade (112), for feeding further substances into the process chamber (140), is provided between the batch container (110) and the process chamber (140).

12. The apparatus as claimed in claim 11, characterized in that an inducer screw (113) is provided between the mixing blade (112) and the process chamber (140), which inducer screw forces the substances intermixed in the mixing chamber (111) in the direction of the process chamber (140).

13. The apparatus as claimed in claim 12, characterized in that the mixing blade (112), the inducer screw (113) and the rotor (150) are mounted on a common shaft (152).

14. The apparatus as claimed in claim 1, characterized in that a receiving chamber (141) for processed substances, which is provided with an outlet opening (130), is provided downstream of the outlet region of the process chamber (140).

15. The apparatus as claimed in claim 14, characterized in that a rotatable distributor blade (142) is provided in the receiving chamber (141).

16. The apparatus as claimed in claim 15, characterized in that the distributor blade (142) is at least indirectly connected to the rotor (150).

17. The apparatus as claimed in claim 14, characterized in that the processed substances, starting from the outlet opening (130) of the receiving chamber (141), can be at least partially fed back into the batch container (110).

18. The apparatus as claimed in claim 14, characterized in that the processed substances, starting from the outlet opening (130) of the receiving chamber (141), can be at least partially fed back into the mixing chamber (111).

19. The apparatus as claimed in claim 1, characterized in that along the rotor (150) upper part and lower part, the rotor's working surface (151) has a structure formed by projections or notches.

20. The apparatus as claimed in claim 1, characterized in that the one or more additional openings (121) comprise a first additional opening and an opposite second additional opening.

* * * * *